US006857533B1

(12) United States Patent
Jackson

(10) Patent No.: US 6,857,533 B1
(45) Date of Patent: Feb. 22, 2005

(54) MOTORCYCLE STORAGE ASSEMBLY

(76) Inventor: Anthony Jackson, 101 Beechwood Dr., Industry, PA (US) 15052

( * ) Notice: Subject to any disclaimer, the term of this patent is extended or adjusted under 35 U.S.C. 154(b) by 320 days.

(21) Appl. No.: 10/158,484

(22) Filed: May 31, 2002

(51) Int. Cl.[7] ..... B65D 85/68
(52) U.S. Cl. ..... 220/4.01; 206/335
(58) Field of Search ..... 206/335; 220/4.24, 220/4.22, 756, 4.01; 297/DIG. 4

(56) References Cited

U.S. PATENT DOCUMENTS 3,886,988 A * 6/1975 Garrett et al. ..... 206/335
4,792,039 A * 12/1988 Dayton ..... 206/304
4,991,715 A * 2/1991 Williams ..... 206/335
6,036,012 A * 3/2000 Haseltine et al. ..... 206/335

* cited by examiner

*Primary Examiner*—Joseph Man-Fu Moy

(57) ABSTRACT

A motorcycle storage assembly for protecting a motorcycle from the elements of the weather and also from possible theft. The motorcycle storage assembly includes a base member having a top side and a bottom side and being adapted to support a motorcycle thereupon; and also includes mirrored cover members each having a wall and a rim being disposed along a perimeter of the wall with the mirrored cover members being detachably attached to one another about the motorcycle; and further includes an assembly for securely fastening the mirrored cover members together.

11 Claims, 3 Drawing Sheets

MOTORCYCLE STORAGE ASSEMBLY

BACKGROUND OF THE INVENTION

1. Field of the Invention

The present invention relates to storage enclosures for motorcycles and more particularly pertains to a new motorcycle storage assembly for protecting a motorcycle from the elements of the weather and also from possible theft.

2. Description of the Prior Art

The use of storage enclosures for motorcycles is known in the prior art. More specifically, storage enclosures for motorcycles heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,533,616; U.S. Pat. No. 3,949,528; U.S. Pat. No. 3,979,147; U.S. Pat. No. 3,861,092; U.S. Pat. No. 5,507,121; and U.S. Pat. No. Des. 361,977.

While these devices fulfill their respective, particular objectives and requirements, the aforementioned patents do not disclose a new motorcycle storage assembly. The prior art discloses inventions which includes base members and cover members, but, in each case, the motorcycle had to be strapped upon the base member.

SUMMARY OF THE INVENTION

The general purpose of the present invention, which will be described subsequently in greater detail, is to provide a new motorcycle storage assembly which has many of the advantages of the storage enclosures for motorcycles mentioned heretofore and many novel features that result in a new motorcycle storage assembly which is not anticipated, rendered obvious, suggested, or even implied by any of the prior art storage enclosures for motorcycles, either alone or in any combination thereof. The inventive device includes a base member having a top side and a bottom side and being adapted to support a motorcycle thereupon; and also includes mirrored cover members each having a wall and a rim being disposed along a perimeter of the wall with the mirrored cover members being detachably attached to one another about the motorcycle; and further includes an assembly for securely fastening the mirrored cover members together. None of the prior art discloses longitudinal slots and holes in the base members which allows the user to freely stand up the motorcycle without having to use straps.

There has thus been outlined, rather broadly, the more important features of the motorcycle storage assembly in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new motorcycle storage assembly which has many of the advantages of the storage enclosures for motorcycles mentioned heretofore and many novel features that result in a new motorcycle storage assembly which is not anticipated, rendered obvious, suggested, or even implied by any of the prior art storage enclosures for motorcycles, either alone or in any combination thereof.

Still another object of the present invention is to provide a new motorcycle storage assembly for protecting a motorcycle from the elements of the weather and also from possible theft.

Still yet another object of the present invention is to provide a new motorcycle storage assembly that is easy and convenient to set up and use.

Even still another object of the present invention is to provide a new motorcycle storage assembly that can be easily moved to any desired location and the user can quickly and easily enclose the motorcycle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
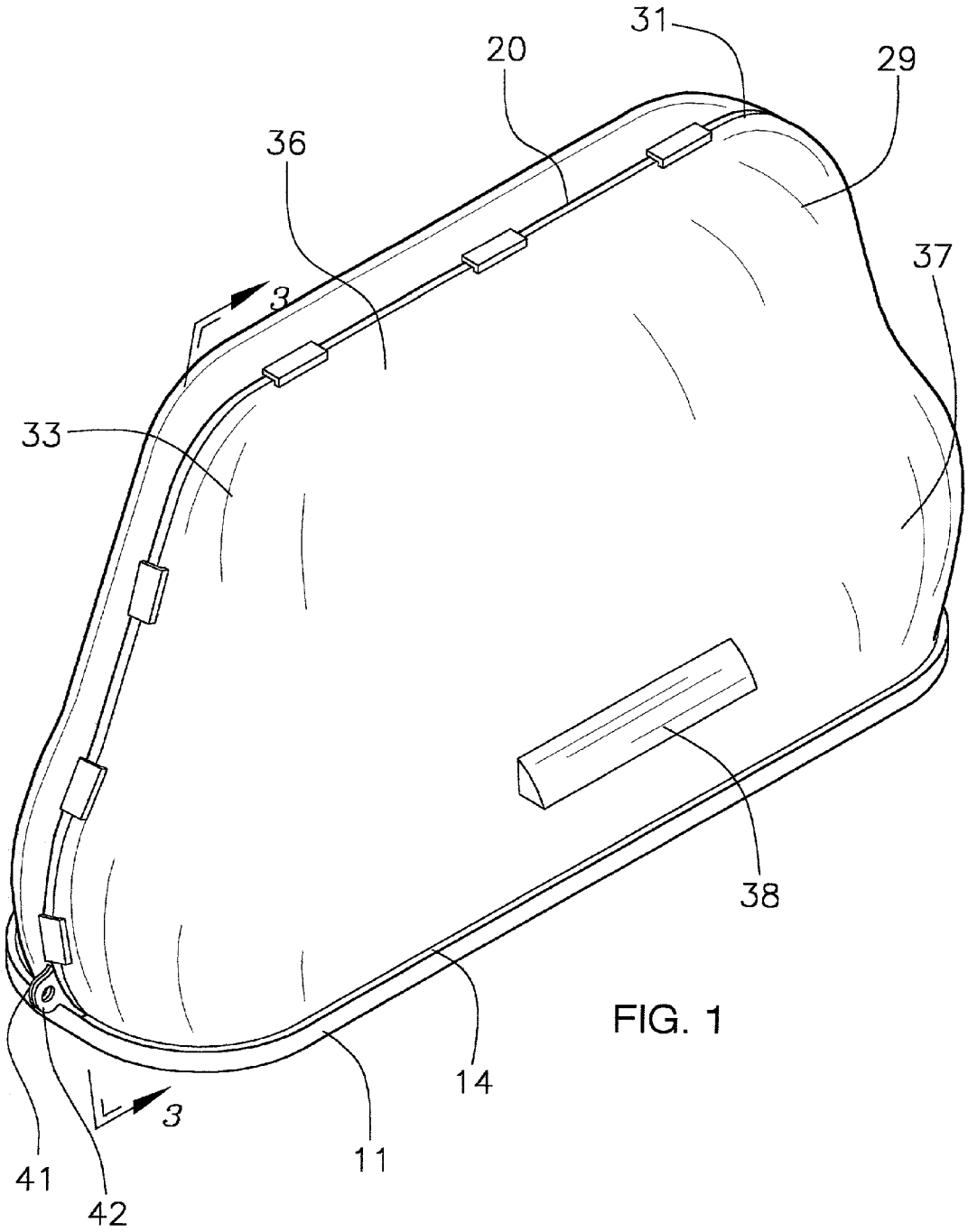
FIG. 1 is a perspective view of a new motorcycle storage assembly according to the present invention and shown in use.
Figure 2:
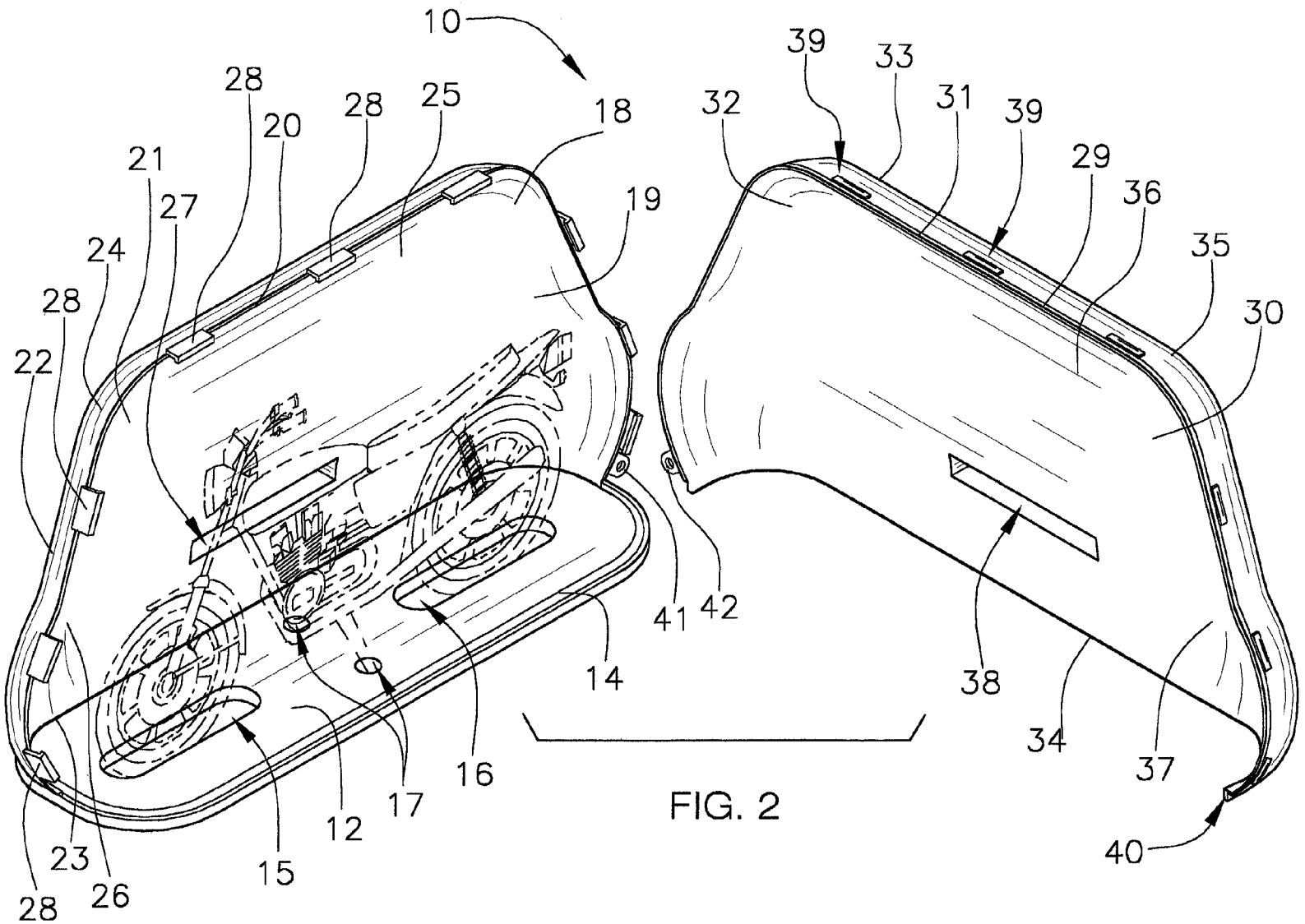
FIG. 2 is an exploded perspective view of the present invention.
Figure 3:
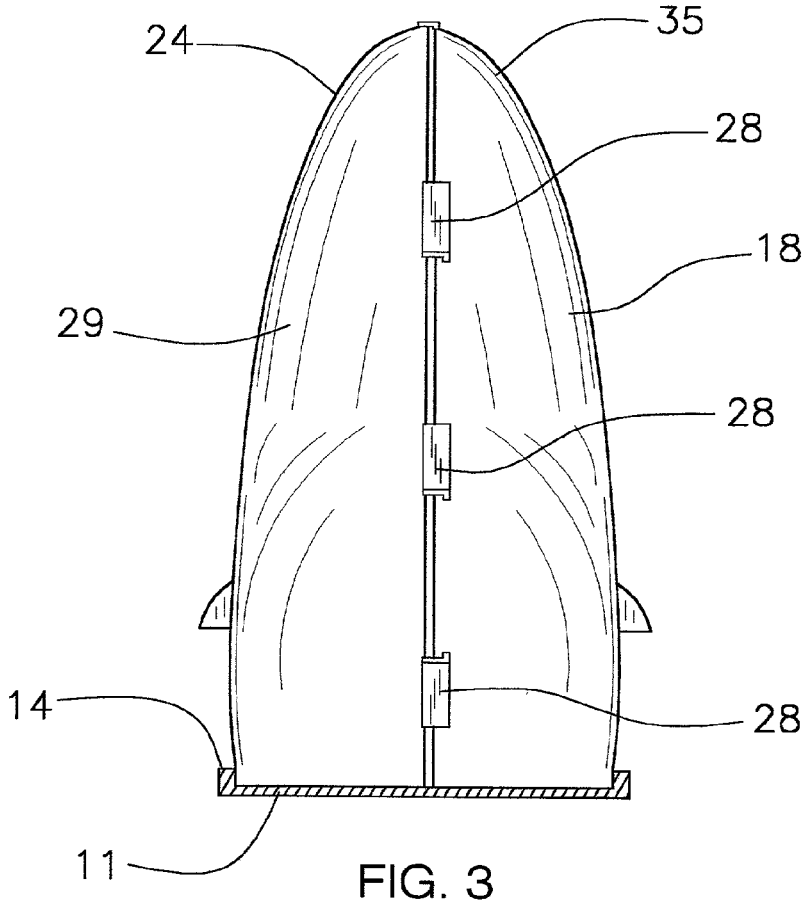
FIG. 3 is an end elevational view of the present invention.
Figure 4:
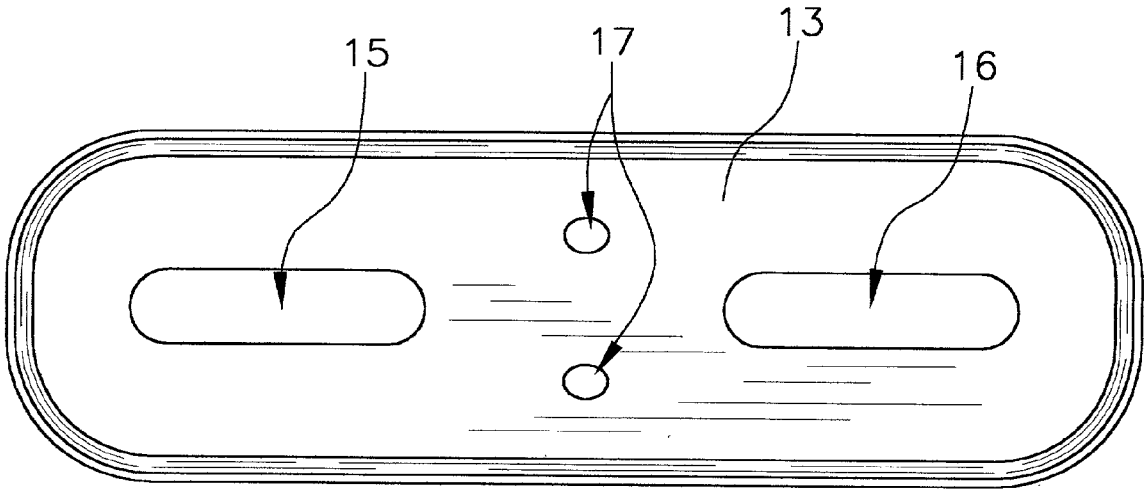
FIG. 4 is a bottom plan view of the present invention

With reference now to the drawings, and in particular to FIGS. 1 through 4 thereof, a new motorcycle storage assembly embodying the principles and concepts of the present invention and generally designated by the reference numeral 10 will be described.

As best illustrated in FIGS. 1 through 4, the motorcycle storage assembly 10 generally comprises a base member 11 having a top side 12 and a bottom side 13 and being adapted to support a motorcycle thereupon. The top and bottom sides 12,13 of the base member 11 are generally flat. The base member also includes a raised lip 14 being disposed upon the top side 12 and along a perimeter of the base member 11. The base member 11 further includes a plurality of longitudinal slots 15,16 being extended therethrough and being longitudinally aligned and spaced and being adapted to receive tires of the motorcycle. The base member 11 also includes at least one hole 17 being extended therethrough and being adapted to receive a kickstand of the motorcycle so that the motorcycle can freely stand upon the base member 11.

The motorcycle storage assembly 10 also includes mirrored cover members 18,29 each having a wall 19,30 and a rim 20,31 being conventionally disposed along a perimeter of the wall 19,30 with the mirrored cover members 18 being detachably attached to one another about the motorcycle. Each of the mirrored cover members 18,29 has an inner side 21,32 and an outer side 22,33 and also has a bottom edge 23,34 and a perimeter portion 24,35 extending from an end of the bottom edge 23,34 to an opposed end of the bottom edge 23,34 with the perimeter portion 24,35 being inwardly curved. Each of the mirrored cover members 18,29 further includes a recessed strip portion 40 being disposed in the outer side 22,33 of the wall 19,30 and extending along the bottom edge 23,34 for receiving the raised lip of the base member 11 and to facilitate supporting the mirrored cover members 18,29 upon the base member 11. Each of the walls 19,30 of the mirrored cover members 18,29 has an upper portion 25,36 and an enlarged lower portion 26,37 relative to the upper portion 25,36 with the walls 19,30 having contoured front and rear edges. The mirrored cover members 18,29 are molded in a shape like that of the motorcycle. The walls 19,30 of the mirrored cover members 18,29 also have a plurality of vents 27,38 being extended through the enlarged lower portions 26,37 thereof and having handles being disposed over said vents and being conventionally attached to the outer sides of the mirrored cover members.

The rim 31 of one of the mirrored cover members 29 has a plurality of clip-receiving slots 39 being spaced therealong and being disposed therethrough.

Means for securely fastening the mirrored cover members 18,29 together includes a plurality of clip members 28 being spaced along and being conventionally attached to an inner side of the rim 20 of one of the mirrored cover members 18 and being securely and removably received in the clip-receiving slots 39 to hold the mirrored cover members 18,29 together. Each of the clip members 28 has a curved outer end portion which removably engages an edge of a respective the clip-receiving slot 39 to securely hold the mirrored cover members 18,29 together. The means for fastening the mirrored cover members 18,29 together further includes eyelets 41,42 being conventionally attached to the rims 20,31 of the mirrored cover members 18,29 with the eyelets 41,42 being in alignment with one another to allow a user to fasten the eyelets 41,42 together.

In use, the user will unfasten and remove one of the mirrored cover members 29 from the base member 11, and will position the motorcycle upon the top side 12 of the base member 11 with the tires of the motorcycle being disposed in the longitudinal slots 15,16 and the kickstand being disposed in the at least one hole 17 to freely stand the motorcycle upon the base member 11. The user will then place the removed mirrored cover member 29 upon the base member 11 with the recessed strip portion 40 lockingly receiving the raised lip 14 of the base member 11, and will position the mirrored cover members 18,29 so that the clip members 28 are received in the clip-receiving slots 39. The use will then use a padlock to lock the eyelets 41,42 together.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the motorcycle storage assembly. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A motorcycle storage assembly comprising:

a base member having a top side and a bottom side and being adapted to support a motorcycle thereupon, said top and bottom sides of said base member being generally flat, said base member also including a raised lip being disposed upon said top side and along a perimeter of said base member;

mirrored cover members each having a wall and a rim being disposed along a perimeter of said wall with said mirrored cover members being detachably attached to one another about the motorcycle; and means for securely fastening said mirrored cover members together.

2. A motorcycle storage assembly as described in claim 1, wherein said base member further includes a plurality of longitudinal slots being extended therethrough and being longitudinally aligned and spaced and being adapted to receive tires of the motorcycle.

3. A motorcycle storage assembly as described in claim 2, wherein said base member also includes at least one hole being extended therethrough and being adapted to receive a kickstand of the motorcycle so that the motorcycle can freely stand upon said base member.

4. A motorcycle storage assembly as described in claim 1, wherein each of said mirrored cover members has an inner side and an outer side and also has a bottom edge and a perimeter portion extending from an end of said bottom edge to an opposed end of said bottom edge, said perimeter portion being inwardly curved.

5. A motorcycle storage assembly as described in claim 4, wherein each of said mirrored cover members further includes a recessed strip portion being disposed in said outer side of said wall and extending along said bottom edge for receiving said raised lip of said base member and to facilitate supporting said mirrored cover members upon said base member.

6. A motorcycle storage assembly as described in claim 5, wherein each of said walls of said mirrored cover members has an upper portion and an enlarged lower portion relative to said upper portion with said walls having contoured front and rear edges, said mirrored cover members being molded in a shape like that of the motorcycle.

7. A motorcycle storage assembly as described in claim 6, wherein said walls of said mirrored cover members also have a plurality of vents being extended through said enlarged lower portions thereof and having handles being disposed over said vents and being attached to said outer sides of said mirrored cover members.

8. A motorcycle storage assembly as described in claim 7, wherein said rim of one of said mirrored cover members has a plurality of clip-receiving slots being spaced therealong and being disposed therethrough.

9. A motorcycle storage assembly as described in claim 8, wherein said means for securely fastening said mirrored cover members together includes a plurality of clip members being spaced along and attached to an inner side of said rim of one of said mirrored cover members and being securely and removably received in said clip-receiving slots to hold said mirrored cover members together.

10. A motorcycle storage assembly as described in claim 9, wherein each of said clip members has a curved outer end portion which removably engages an edge of a respective said clip-receiving slot to securely hold said mirrored cover members together.

11. A motorcycle storage assembly comprising:

a base member having a top side and a bottom side and being adapted to support a motorcycle thereupon;

mirrored cover members each having a wall and a rim being disposed along a perimeter of said wall with said mirrored cover members being detachably attached to one another about the motorcycle; and means for securely fastening said mirrored cover members together said means for fastening said mirrored cover members together further including eyelets being attached to said rims of said mirrored cover members, said eyelets being in alignment with one another to allow a user to fasten said eyelets together.

* * * * *